US010759027B2

(12) United States Patent
Eggert et al.

(10) Patent No.: US 10,759,027 B2
(45) Date of Patent: Sep. 1, 2020

(54) SOCKET AND BIT RETENTION

(71) Applicant: Snap-on Incorporated, Kenosha, WI (US)

(72) Inventors: Daniel M Eggert, Kenosha, WI (US); Marco E DeVecchis, Racine, WI (US)

(73) Assignee: Snap-on Incorporated, Kenosha, WI (US)

( * ) Notice: Subject to any disclaimer, the term of this patent is extended or adjusted under 35 U.S.C. 154(b) by 595 days.

(21) Appl. No.: 14/211,809

(22) Filed: Mar. 14, 2014

(65) Prior Publication Data

US 2014/0260826 A1 Sep. 18, 2014

Related U.S. Application Data

(60) Provisional application No. 61/782,991, filed on Mar. 14, 2013.

(51) Int. Cl.
*B25B 23/00* (2006.01)
*B25B 13/06* (2006.01)

(52) U.S. Cl.
CPC ..... *B25B 23/0035* (2013.01); *B25B 13/06* (2013.01)

(58) Field of Classification Search
CPC ..... B25B 23/0035; B25B 13/06; B25B 23/00; B25B 23/0007; B25G 3/02; B25G 3/12; B25G 3/24
USPC ..... 81/121.1, 125, 124.6, 59.1
See application file for complete search history.

(56) References Cited

U.S. PATENT DOCUMENTS 1,578,065 A * 3/1926 Bemus ..... B25B 13/463 81/177.2
1,873,472 A * 8/1932 Pfauser ..... B25B 13/463 254/2 B
3,326,335 A * 6/1967 Billeter ..... B61H 15/0057 188/196 D
3,956,606 A * 5/1976 Reiter ..... H01H 3/0226 200/518
4,631,989 A * 12/1986 Trowbridge ..... B25B 13/06 81/177.85
5,168,782 A * 12/1992 Cromwell ..... B25B 23/0021 81/177.2
5,485,769 A * 1/1996 Olson ..... B25B 23/0035 81/177.85
5,509,333 A * 4/1996 Rion ..... B25B 13/461 81/177.85
5,752,418 A * 5/1998 Robins ..... B25B 23/0035 81/177.2
6,092,441 A * 7/2000 Jarvis ..... B25B 23/0021 81/177.2
6,134,991 A * 10/2000 Chaconas ..... B25B 13/463 81/63
6,367,356 B1 * 4/2002 Stepp ..... B25B 23/0035 81/177.2

(Continued)

*Primary Examiner* — David B. Thomas
(74) *Attorney, Agent, or Firm* — Seyfarth Shaw LLP

(57) ABSTRACT

A tool including a bit including a detent portion in the form of a detent ball and a bias member adapted to provide a biasing force to the detent ball in an outward direction. The detent ball is adapted to engage a receiving portion in a socket to securely couple the bit to the socket. The biasing force may be sufficient to prevent the bit from being accidentally removed from coupling to the socket by hand after assembly. In one aspect, the bit may be removed from the socket upon application of an axial force of about 40 pounds or greater.

19 Claims, 5 Drawing Sheets

(56) References Cited

U.S. PATENT DOCUMENTS

| | | | | |
|---|---|---|---|---|
| 6,712,726 | B1 * | 3/2004 | Jackson | F16H 61/0021 137/512.3 |
| 7,026,574 | B2 * | 4/2006 | Belfiore | B23K 9/1336 219/137.7 |
| 2007/0044602 | A1 * | 3/2007 | Petit | B25B 23/0035 81/438 |
| 2013/0134684 | A1 * | 5/2013 | Funk | B25B 23/0035 279/9.1 |

* cited by examiner

SOCKET AND BIT RETENTION

CROSS REFERENCES TO RELATED APPLICATIONS

This application claims the benefit of U.S. Provisional Patent Application Ser. No. 61/782,991, SOCKET AND BIT RETENTION, filed Mar. 14, 2013, the contents of which are incorporated herein by reference in their entirety.

TECHNICAL FIELD OF THE INVENTION

The present application relates to tools for driving fasteners, and in particular to adapters for tools.

BACKGROUND OF THE INVENTION

A variety of wrenches and tools are commonly used to apply torque to a workpiece, such as a threaded fastener. In some situations, these tools may also apply an impact force to fasteners that may be difficult or require large amounts of torque to install or remove.

The workpiece may have any number of different sizes and shapes. Accordingly, many tools include a driver which mates with any of a number of different adapters, such as sockets and bits, to engage and rotate the different-sized workpieces. The bit and socket are typically secured together in a rigid fashion. In one example, the bit is secured to the socket through the use of a roll pin. In another example, the bit is dimpled and the bit is pressed into the socket. However, these modes of securement can cause the bit to wear, and even cause the securing portion to loosen or break, thus causing failure of the bit.

SUMMARY OF THE INVENTION

The present application discloses adapters including a bit and a socket. In an embodiment, the socket is adapted to be removably coupled to a tool, such as, for example, an impact wrench. In an embodiment, the bit includes a detention portion in the form of a detent ball and a bias member provides a biasing force to the detent ball in an outwardly direction relative to the bit. The detent ball is adapted to matingly engage a receiving portion in the socket to couple the bit to the socket. In one aspect, the spring force is sufficient to prevent the bit from being removed from coupling to the socket by hand after assembly. In an embodiment, a distal end of the bit is adapted to be removably coupled to a fastening tool, such as, for example, a ratchet socket. In another embodiment, the distal end of the bit may be formed into a tool for engaging a fastener, for example, a Philips head, Torx® head, flathead screwdriver.

The bias member may be a coil spring adapted to provide the biasing force. In an embodiment, the spring further provides a dampening effect that counteracts an impacting force, for example, provided by an impact driver or impact wrench when the bit is used in conjunction with one of these tools. For example, the detent ball may be depressed against the biasing force when a rotational impacting force is applied, which may cause the bit to rotate a small amount within the socket. This allows the bit to absorb some of the impacting energy compared to a bit that may be rigidly secured to the socket. The biasing force counteracts the impacting force by biasing the detent ball outwardly, such that the circular shape of the detent ball naturally reengages the receiving portion in the socket causing the bit to substantially realign in the socket. Thus, by counteraction of the impacting force, the bit does not receive full impacting blows from the impact driver or impact wrench.

In an embodiment, a tool of the present application includes an elongated body having an exterior surface and first and second ends. A receiving cavity radially extends from the exterior surface into the elongated body proximal to the second end, and a detent ball is disposed in the receiving cavity and is adapted to engage a socket. A bias member is also disposed in the receiving cavity to abut an inner side thereof and is adapted to bias the detent ball in an outwardly direction relative to the exterior surface. The bias member provides a force that enables the detent ball to securely retain the bit in the socket when the detent ball matingly engages a detent receiving portion of the socket. When the detent ball is engaged with the socket, the elongated body is removable from the socket upon application of an axial force of greater than 20 pounds. In one aspect, the force is such that the elongated body is removable from the socket upon application of an axial force greater than 40 pounds, thus preventing inadvertent removal of the bit from the socket.

The detent ball and spring can provide the advantages of enabling a secure, releasable connection between the bit and the socket, while reducing the risk of the connection between the bit and the socket from loosening, reducing wear on the bit and the socket, and providing a longer service life as opposed to prior art bits and sockets.

BRIEF DESCRIPTION OF THE DRAWINGS

Embodiments of devices and methods are illustrated in the figures of the accompanying drawings which are meant to be exemplary and not limiting, in which like references are intended to refer to like or corresponding parts, and in which.

DETAILED DESCRIPTION OF THE EMBODIMENTS

Detailed embodiments of devices and methods are disclosed herein. However, it is to be understood that the disclosed embodiments are merely exemplary of the devices and methods, which may be embodied in various forms. Therefore, specific functional details disclosed herein are not to be interpreted as limiting, but merely as a basis for the claims and as a representative example for teaching one skilled in the art to variously employ the present disclosure.

The present application relates to adapters including a bit and a socket. The bit includes a detention portion in the form of a detent ball and a bias member providing a biasing force to the detent ball in an outward or radial direction relative to an exterior surface of the bit. In an embodiment, the detent ball is adapted to matingly engage a detent receiving portion disposed in the socket to securely couple the bit to the socket for use. In one embodiment, the socket is adapted to couple with a lug of a tool, for example, a hand tool, a socket wrench, an impact driver, an impact wrench, and other tools.

The biasing force of the bias member or spring is sufficient to require an axial force of about 25 pounds to about 200 pounds, including all ranges and sub-ranges therebetween, to be applied to the bit to disengage the bit from the socket. The spring is also adapted to provide a dampening effect that counteracts an impacting force, for example, provided by an impact driver or impact wrench when the bit is used in conjunction with one of these tools. For example, the detent ball may be depressed against the biasing force when a rotational impacting force is applied, which may cause the bit to rotate a small amount within the socket. This allows the bit to absorb some of the impacting energy compared to a bit that may be rigidly secured to the socket. The biasing force counteracts the impacting force by biasing the detent ball outwardly, such that the circular shape of the detent ball naturally reengages the receiving portion in the socket causing the bit to return to realign in the socket. By counteracting the impacting force, the bit does not receive full impacting blows from the impact driver or impact wrench, which can reduce wear on the bit and provide a longer service life for the bit.

Figure 1:
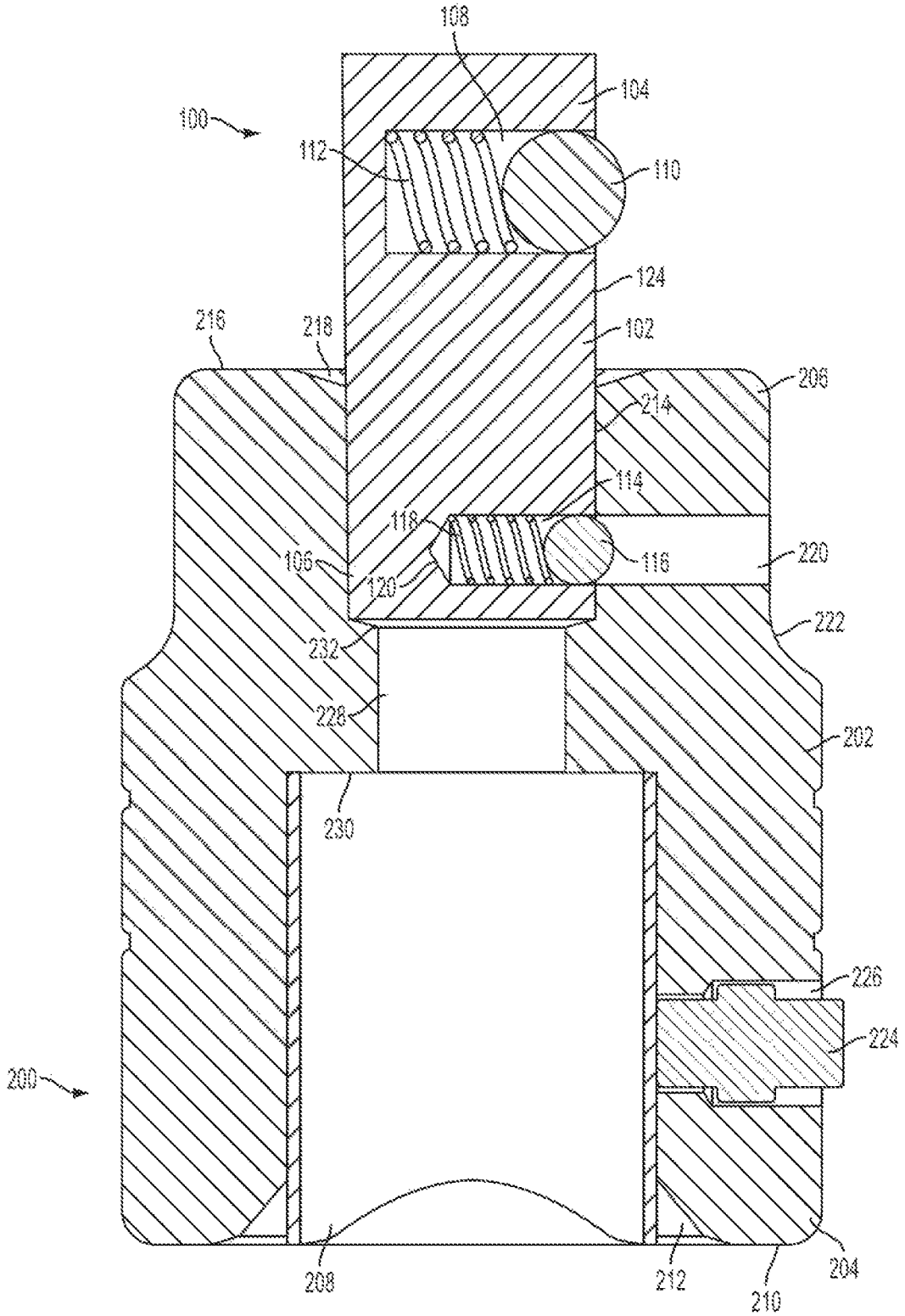
FIG. 1 is a cross-sectional side view of a bit and socket in accordance with an embodiment of the present application.

As illustrated in FIG. 1, the adapter includes a bit 100 and socket 200. The bit 100 is adapted to be received in the socket 200 and be coupled with the socket 200. The bit 100 includes an elongated body 102 having opposing first and second ends 104, 106. The first end 104 includes a first detent cavity 108, and a first detent ball 110 and a first bias member 112 are disposed in the first detent cavity 108. In an embodiment, the diameter of the first detent cavity 108 adjacent to the exterior surface 124 is less than the diameter of the first detent ball 110, thereby preventing the first detent ball 110 from being removed from the first detent cavity 108. Similarly, the second end 106 includes a second detent cavity 114, and a second detent ball 116 and a second bias member 118 are disposed in the second detent cavity 114. In an embodiment, the diameter of the second detent cavity 115 adjacent to the exterior surface 124 is less than the diameter of the second detent ball 116, thereby preventing the second detent ball 116 from being removed from the second detent cavity 115. In an embodiment, the diameters of the first detent ball 110 and first detent cavity 108 are respectively greater than the diameters of the second detent ball 116 and second detent cavity 115.

Figure 2:
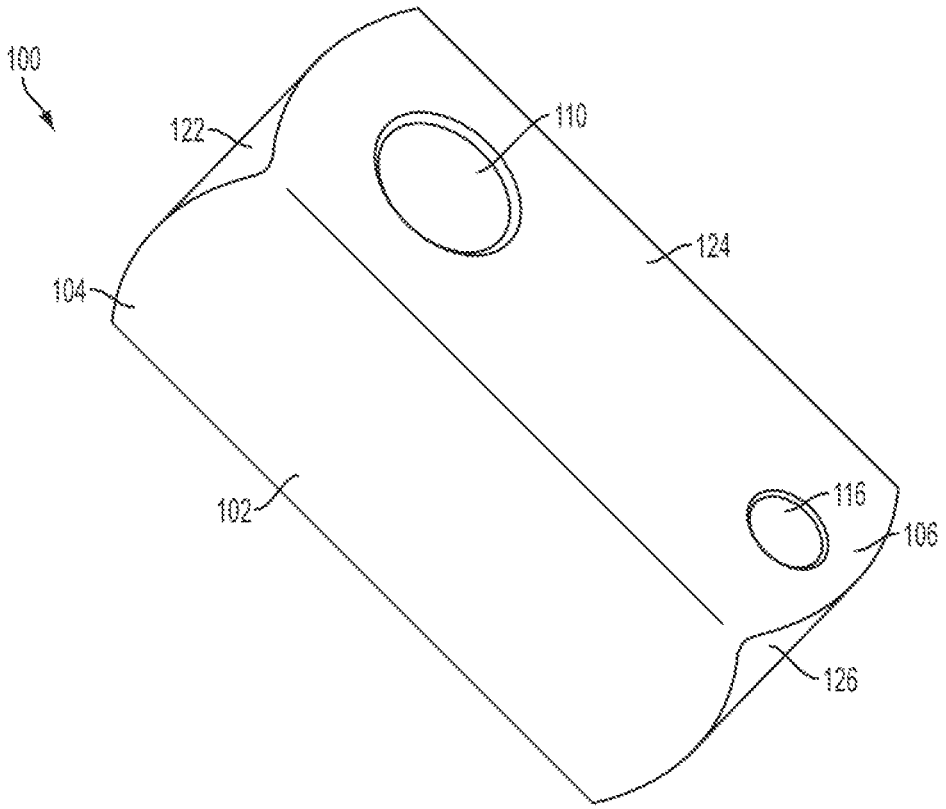
FIG. 2 is a perspective side view of the bit in accordance with an embodiment of the present application.

Referring to FIGS. 1 and 2, in an embodiment, the elongated body 102 has a squared cross-sectional shape perpendicular to an axis extending through the elongated body 102 from the first end 104 to the second end 106. This squared shape may be adapted to mate with a receptacle of a socket, a socket wrench, an impact wrench, an impact driver, or a receptacle of other tools and accessories. The squared cross-sectional shape may be, for example, about a ½ inch square. In other embodiments, the cross-section shape of the elongated body 102 may be larger or smaller, for example, a ¼ inch square, a ⅜ inch square, a ¾ inch square, a 1 inch square, a 1 and ½ inch square, etc., inclusive of all ranges and sub-ranges therebetween. In yet other embodiments, the elongated body 102 may be formed to have different cross-sectional shapes adapted to mate with different shaped receptacles of different tools, for example, the cross-sectional shape of the elongated body 102 may be triangular, rectangular, pentagonal, hexagonal, heptagonal, octagonal, hex shaped or other shapes of the type.

Figure 3:
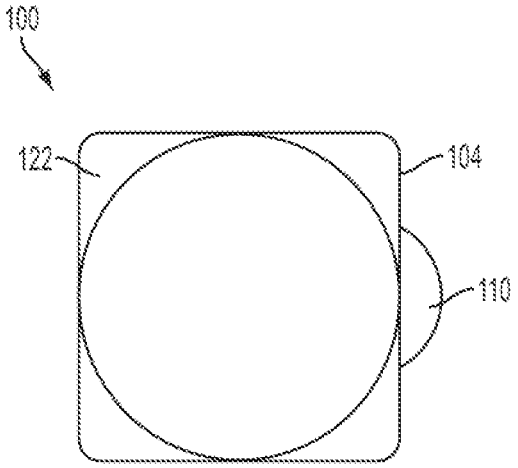
FIG. 3 is a top plan view of the bit in accordance with an embodiment of the present application.

Referring to FIGS. 1-3, the first end 104 may include first edge breaks 122. The first edge breaks 122 may be in the form of tapers or chamfers at corner edges of the first end 104. The first edge breaks 122 are adapted to allow for easier mating insertion of the first end 104 into a receptacle of a corresponding tool and/or socket.

The first detent cavity 108 may be a bore hole that extends from an external surface 124 of the elongated body 102 into an interior of the elongated body 102. In one embodiment, the first detent ball 110 and the first bias member 112 are disposed in the first detent cavity 108, and the first detent cavity 108 is annular embossed. The first bias member 112 is adapted to exert an outwardly bias force on the first detent ball 110, thereby biasing the first detent ball 110 in a direction toward the external surface 124. In an embodiment, the first bias member 112 may be a helical compression spring that exerts a spring force on the first detent ball 110. As illustrated in FIG. 3, a portion of the first detent ball 110 is adapted to protrude from the external surface 124, as a result of the force of the first bias member 112, to mate with a corresponding receptacle of a socket or tool. In an embodiment, the first detent ball 110 protrudes a distance of about 0.05 inches to about 0.07 inches, more particularly, about 0.63 inches from the external surface 124. In other embodiments, the protrusion distance may be increased or decreased based on the size of the first detent ball 110 and bit 100.

Figure 4:
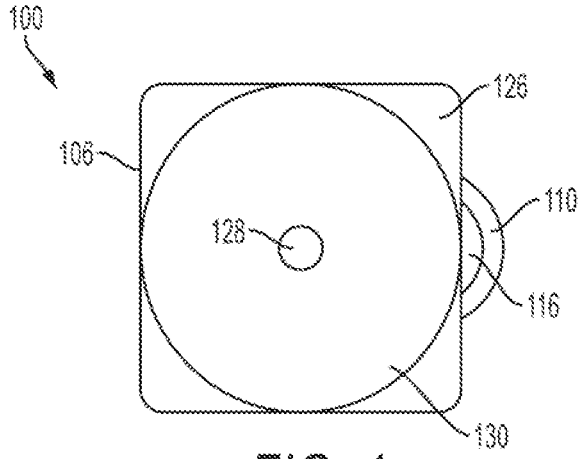
FIG. 4 is a bottom plan view of the bit in accordance with an embodiment of the present application.
Figure 5:
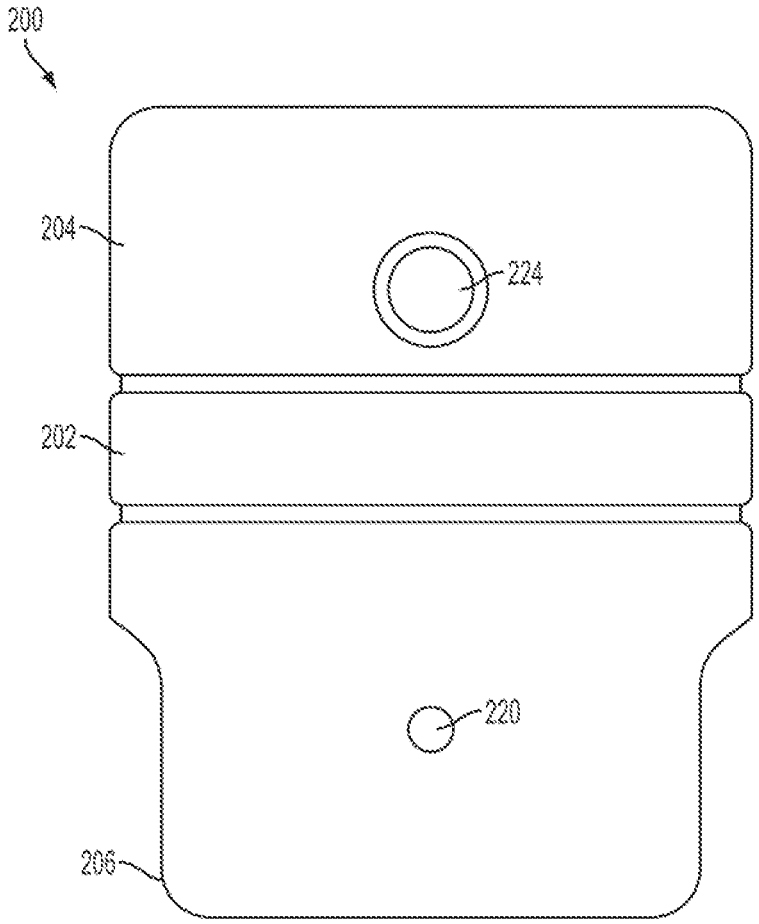
FIG. 5 is a side elevation view of the socket in accordance with an embodiment of the present application.
Figure 6:
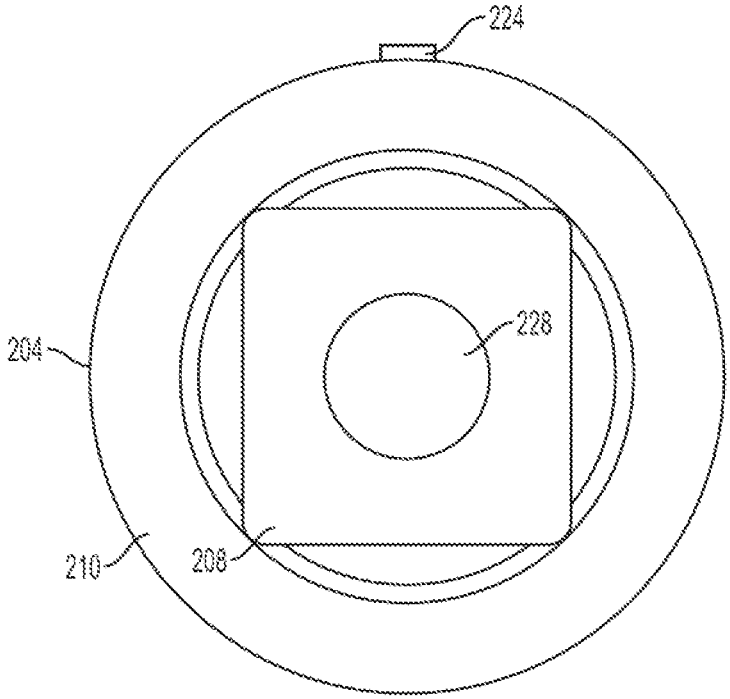
FIG. 6 is a top plan view of the socket in accordance with an embodiment of the present application.
Figure 7:
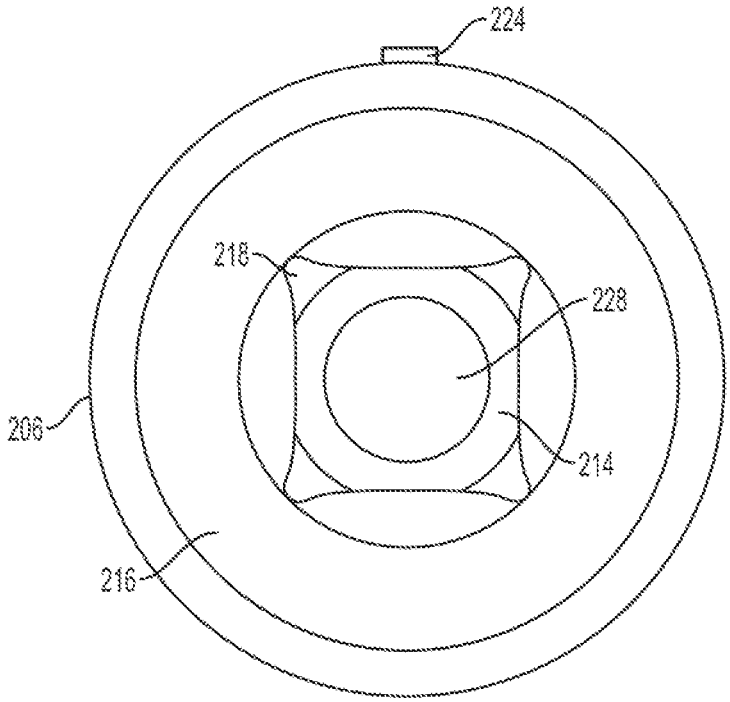
FIG. 7 is a bottom plan view of the socket in accordance with an embodiment of the present application.

Referring to FIG. 4, the second end 106 may also include edge breaks, for example, second edge breaks 126, at corner edges of the first end 106, in the form of tapered or chamfered edges. The second end 106 may also include a bore hole 128 in an external surface 130 of the second end 106. The bore hole 128 may extend from the external surface 130 into the elongated body 102 and be axially centered on the external surface 130.

Referring to FIG. 1, the second detent cavity 114 may also be a bore hole that extends from the external surface 124 of the elongated body 102 into the interior of the elongated body 102. In an embodiment, the second detent cavity 114 terminates in a tapered end 120 within the elongated body 102. The second detent ball 116 and the second bias member 118 are disposed in the second detent cavity 114, and the second detent cavity 114 is annularly embossed. The second bias member 114 exerts an outwardly bias force on the second detent ball 116 biasing the second detent ball 116 in a direction of the external surface 124. In an embodiment, the second bias member 118 may also be a helical compression spring that exerts a spring force on the second detent ball 116. As illustrated in FIG. 4, a portion of the second detent ball 116 protrudes from the external surface 124 as a result of the force of the second bias member 118. In an embodiment, the second detent ball 116 protrudes a distance of about 0.03 inches to about 0.04 inches, more particularly, about 0.35 inches from the external surface 124. In other embodiments, the protrusion distance may be increased or decreased based on the size of the first detent ball 116 and bit 100.

Referring to FIGS. 1 and 4, the first detent ball 110 may have a first diameter larger than a second diameter of the second detent ball 116. In one embodiment, the first diameter is about 0.13 to about 0.14 inches, and more particularly, about 0.135 inches, and the second diameter is about 0.12 to about 0.13 inches, and more particularly, about 0.125 inches. In other embodiments the first diameter and the second diameter may be may be increased or decreased by a same ratio. In yet other embodiments, the first diameter and the second diameter may be about equal.

Referring to FIGS. 1 and 2, a distance of the first detent ball 110 and first detent cavity 108 from an edge of the first end 104 is greater than a distance of the second detent ball 116 and second detent cavity 115 from an edge of the second end 106. In an embodiment, the elongated body 102 may have a length of about 1 inch to about 2 inches, and more particularly, about 1.158 inches. A center of the second detent ball 116 may be spaced a distance of about 0.1 inches to about 0.15 inches, and more particularly, about 0.135 inches from an edge of the second end. The center of the second detent ball 116 may also be spaced a distance of about 0.8 inches to about 1 inches, more particularly, about 0.875 inches from a center of the first detent ball 110. In other embodiments, the length of the elongated body portion 102 and the spacing of the detent balls may be increased or decreased based on the size of the bit 100.

While the first end 104 and the second end 106 are described as having a same cross-sectional shape and size, the first end 104 and the second end 106 may have differing cross-sectional shapes and sizes. For example, the first end 104 can be sized or shaped to be removably coupled to a tool engagement, such as, for example, a ratchet socket or other type of tool, and it may have a rectangular, hex or other cross-sectional shape. In another embodiment, the first end 104 may be a driving end having a hex, screwdriver head or socket head adapted to engage a fastener. For example, the first end 104 may be a hex head, a Torx® head, a Phillips-head or cross-head, a slot-head, a square head, and other driving heads adapted to directly engage a fastener. The first end 104 may also be triangular, rectangular, pentagonal, hexagonal, heptagonal, octagonal, and other shapes of the type adapted to mate with different shaped receptacles of different sockets and tools.

In an embodiment, the second end 106 of the bit 100 is adapted to be matingly inserted into a receptacle of a socket and the second detent ball 116 is adapted to cooperatively engage a detent receiving portion disposed in the socket to securably couple the bit 100 to the socket. In this embodiment, the second bias member 118 is adapted to exert a force sufficient to require an axial force of about 40 pounds to be applied to the bit 100 to remove the bit 100 from the socket. In other embodiments, the second bias member 118 may be adapted to exert a force sufficient to require an axial force of about 25 pounds to about 75 pounds, including all ranges and sub-ranges therebetween. This biasing force may also counteract an impacting force by biasing the detent ball outwardly, such that the circular shape of the detent ball causes the detent ball to reengage the receiving portion in the socket causing the bit to realign the bit in the socket. By counteracting the impacting force, the bit does not receive full impacting blows from the impact driver or impact wrench, which reduces wear on the bit and provides a longer service life for the bit.

For example, referring to FIGS. 1 and 5-7, the socket 200 includes a body portion 202 having opposing first and second ends 204, 206. The first end 204 includes a first receptacle 208 extending from a first external surface 210 into the body portion 202 in a direction of the second end 206. The first receptacle 208 may include edge breaks 212, for example, in the form of tapers or chamfers at corner edges of the first receptacle 208 proximate to the first external surface 210. The first receptacle 208 has a cross-sectional shape perpendicular to an axis extending through the socket 200 from the first end 204 to the second end 206. The cross-sectional shape may be, for example, triangular, square, pentagonal, hexagonal, heptagonal, octagonal, and other shapes of the type, and adapted to receive and mate with a bit, a fastener, a socket wrench, an impact wrench, an impact driver, or other tools and accessories.

In one embodiment, the first receptacle 208 has a square cross-sectional shape, for example, about a ¾ inch square. In other embodiments, the cross-section shape of the first receptacle 208 may be larger or smaller, for example, a ¼ inch square, a ⅜ inch square, a ½ inch square, a 1 inch square, a 1 and ½ inch square etc., inclusive of all ranges and sub-ranges therebetween.

The second end includes a second receptacle 214 extending from a second external surface 216 into the body portion 202 in a direction of the first end 204. The second receptacle 214 may also include edge breaks 218, for example, in the form of tapers or chamfers at corner edges of the second receptacle 214 proximate to the second external surface 216. Similar to the first receptacle 208, the second receptacle 214 may have a cross-sectional shape perpendicular to an axis extending through the socket 200, for example, triangular, square, pentagonal, hexagonal, heptagonal, octagonal, and other shapes of the type, and adapted to receive and mate with a bit, a fastener, a socket wrench, an impact wrench, an impact driver, or other tools and accessories.

In the embodiment illustrated in FIGS. 1 and 5-7, the second receptacle 214 has a squared cross-section shape adapted to receive the second end 106 of the bit 100. The second receptacle 214 may have a square cross-sectional shape, for example, about a ½ inch square. In other embodiments, the cross-section shape of the second receptacle 214 may be larger or smaller, for example, a ¼ inch square, a ⅜ inch square, a ¾ inch square, a 1 inch square, a 1 and ½ inch square etc., inclusive of all ranges and sub-ranges therebetween.

Referring to FIG. 1, the socket 200 also includes a detent receiving portion 220 extending perpendicular to the axis extending through the socket 200 from the first end 204 to the second end 206. In this embodiment, the detent receiving portion 220 is a through hole that extends from a side exterior surface 222 of the socket to the second receptacle 214. The detent receiving portion 220 is adapted to cooperatively engage the second detent ball 116 when the bit 100 is disposed in the second receptacle 214 and couple the bit 100 to the socket 200. As described above, this engagement is adapted to require an axial force of about 40 pounds to be applied to the bit 100 to remove the bit 100 from the socket 200.

In one embodiment, the detent receiving portion 220 has a diameter, for example, about 0.1 to about 0.11 inches. In other embodiments, the diameter of the detent receiving portion 220 may be larger or smaller and adapted to engage the detent ball of the bit.

The socket may also include a button 224 disposed in a button receiving portion 226 extending perpendicular to the axis extending through the socket 200 from the first end 204 to the second end 206 from the side exterior surface 222 of the socket to the first receptacle 208. The button 224 may be disposed in the button receiving portion 226 and the button receiving portion 226 may be annularly embossed. The button 224 is adapted to protrude into the first receptacle 208 upon receiving a force to contact a bit, a fastener, a socket wrench drive lug, an impact wrench drive lug, an impact driver, or other tool or accessory that may be disposed in or mated with the first receptacle 208. This can be used to assist in removal of the tool or accessory from the first receptacle 208.

As illustrated in FIG. 1, the socket 200 may also include an aperture or hole 228 extending between the first receptacle 208 and the second receptacle 214. As illustrated, the first receptacle 208 extends from the first external surface 210 of the body portion 202 to a first shoulder 230, the hole 228 extends from the first shoulder 230 to a second shoulder 232, and the second receptacle 214 extends from the second shoulder 232 to the second external surface 216 of the body portion 202. This allows the bore hole 128 in the external surface 130 of the second end 106 of the bit 100 to be visible through the first receptacle 208 when the bit 100 is disposed in the socket 200.

In an embodiment, the first external surface 210 has a diameter of about 1.4 inches to about 1.5 inches, and more particularly, about 1.425 inches. In other embodiments, the diameter of the first external surface 210 may be larger or smaller, for example, 0.5 inches, 1 inch, 1.5 inches, 2 inches, 5 inches, 10 inches, etc., inclusive of all ranges and sub-ranges therebetween. Similarly, in an embodiment, the second external surface 216 has a diameter of about 1.2 inches to about 1.25 inches, and more particularly, about 1.2 inches. In other embodiments, the diameter of the second external surface 216 may be larger or smaller, for example, 0.5 inches, 1 inch, 1.5 inches, 2 inches, 5 inches, 10 inches, etc., inclusive of all ranges and sub-ranges therebetween.

In an embodiment, the body portion 202 of the socket 200 has a length from the first external surface 210 to the second external surface 216 of about 1.75 inches to about 1.9 inches, more particularly, about 1.8 inches. In this embodiment, the first receptacle 208 has a length or depth of about 0.93 inches to about 0.1 inches, more particularly about 0.95 inches; and the second receptacle 214 has a length or depth of about 0.48 inches to about 0.55 inches, more particularly about 0.5 inches. In other embodiments, the length of the body portion 202, the first receptacle 208, and the second receptacle 214 may be increased or decreased based on the size of the socket 200.

Figure 8:
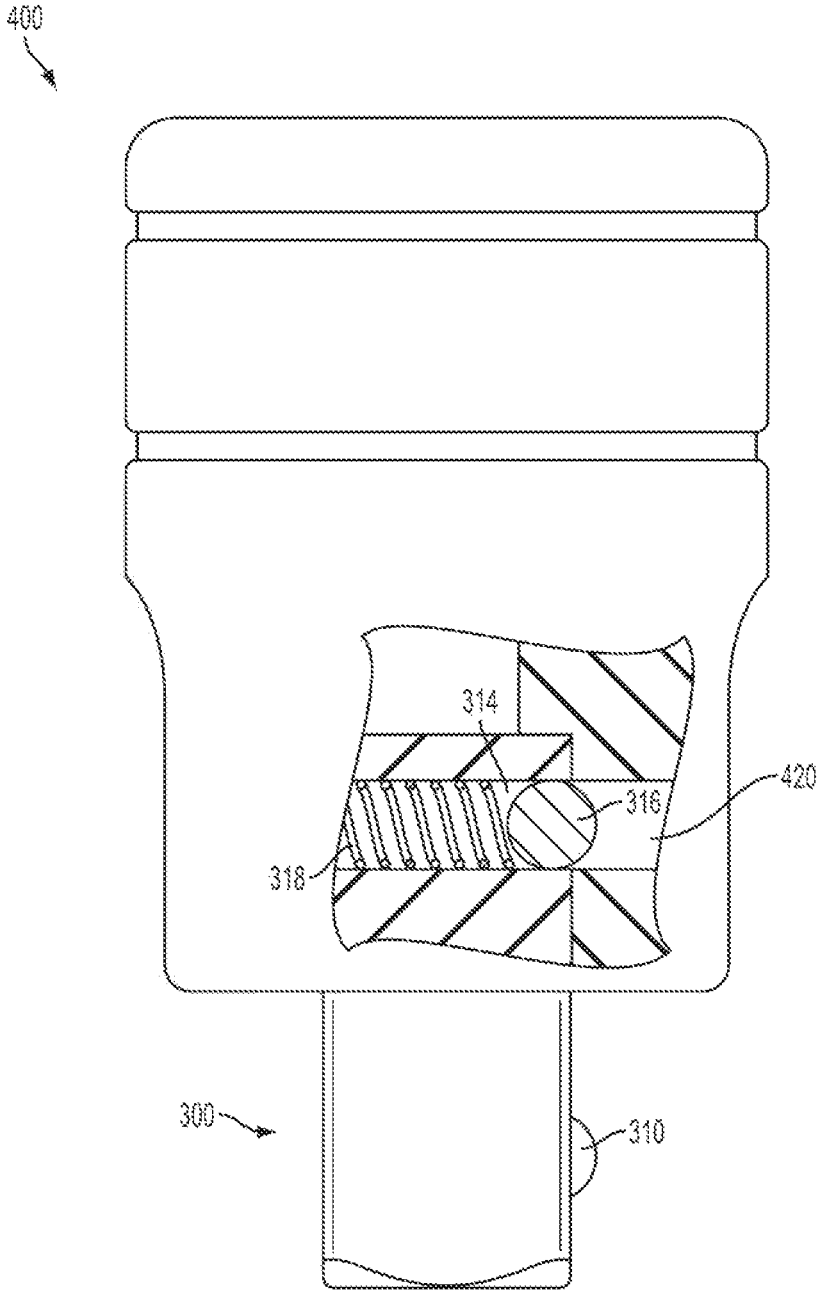
FIG. 8 is a side, partial cross-sectional view of a bit coupled to a socket in accordance with another embodiment of the present application.

Another embodiment of the bit and socket is illustrated in FIG. 8. In this embodiment, the bit 300 and socket 400 are the same as the bit 100 and the socket 200 described above with the following alterations. Second detent ball 316 disposed in second detent cavity 314 with second bias member 318 and has a second diameter less than a first diameter of first detent ball 310. In this embodiment, the second detent ball 316 engages detent receiving portion 420 to couple the bit 300 to the socket 400. The second bias member 318 may be adapted to exert a force sufficient to require an axial force of about 40 pounds or greater to be applied to the bit 300 in order to remove the bit 300 from the socket. In other embodiments, the second bias member 318 may be adapted to exert a force sufficient to require an axial force of about 25 pounds to about 75 pounds, including all ranges and sub-ranges therebetween.

In the embodiments described above, the detent ball engaging the detent receiving portion of the socket and the biasing force of the bias member or spring cause may provide a dampening effect that counteracts a rotational force, for example, provided by a socket wrench, an impact driver, an impact wrench, or other wrench when the bit is used in conjunction with one of these tools. For example, the detent ball may be depressed against the biasing force when a rotational force is applied to the bit, which may allow the bit to rotate a small amount within the socket. This allows the bit to absorb some of the energy from the rotational force compared to a bit that may be rigidly secured to the socket. The biasing force counteracts the rotational force by biasing the detent ball outward, such that the detent ball reengages the receiving portion in the socket causing the bit to return to realign in the socket. By counteracting the impacting force, the bit may not receive full impacting blows, which can reduce wear on the bit and provide a longer service life for the bit.

The sizes and dimensions of the various elements of the bits and sockets described herein may be modified or adapted for a particular use with one or more different tools. For example, the socket may be adapted to receive different fastener sizes, for example, 10 mm, 12 mm, 14 mm, etc., as known in the art. Similarly, the size of the elongated body and its cross-sectional shape can be adapted to be received by different sizes and types of sockets, tools, and accessories.

Although the devices and methods have been described and illustrated in connection with certain embodiments, many variations and modifications will be evident to those skilled in the art and may be made without departing from the spirit and scope of the present disclosure. The present disclosure is thus not to be limited to the precise details of methodology or construction set forth above as such variations and modification are intended to be included within the scope of the present disclosure. Moreover, unless specifically stated any use of the terms first, second, etc. do not denote any order or importance, but rather the terms first, second, etc. are merely used to distinguish one element from another.

What is claimed is:

1. A tool having a body with an exterior surface and adapted to matingly engage a socket having a detent receiving portion, comprising:

a first receiving cavity extending from the exterior surface into the body proximal to a first end of the body;

a first detent ball disposed in the first receiving cavity and adapted to engage the detent receiving portion when the first end is matingly engaged with the socket; and a first bias member disposed in the receiving cavity and adapted to bias the first detent ball in an outwardly direction relative to the exterior surface and into engagement with the detent receiving portion when the first end is matingly engaged with the socket, wherein when the first detent ball engages the detent receiving portion within the socket, the first bias member provides a biasing force against the first detent ball requiring an axial force greater than 20 pounds to disengage the first detent ball from the detent receiving portion within the socket to allow removal of the body from the socket, and wherein the biasing force counteracts an impacting rotational force applied to the body when the tool is in use.

2. The tool of claim 1, wherein the axial force must be greater than 40 pounds to disengage the first detent ball from the detent receiving portion within the socket to allow removal of the body from the socket.

3. The tool of claim 1, further comprising a second receiving cavity extending from the exterior surface into the body proximal to a second end of the body.

4. The tool of claim 3, further comprising a second detent ball disposed in the second receiving cavity.

5. The tool of claim 4, further comprising a second bias member disposed in the second receiving cavity and adapted to bias the second detent ball in an outwardly direction relative to the exterior surface and into engagement with the detent receiving portion when the second end is matingly engaged with the socket.

6. The tool of claim 4, wherein the first detent ball has a first diameter less than a second diameter of the second detent ball.

7. The tool of claim 4, wherein the first detent ball has a first diameter greater than a second diameter of the second detent ball.

8. The tool of claim 4, wherein the first receiving cavity is spaced a first distance from an edge of the first end, and the second receiving cavity is spaced a second distance from an edge of the second end that is greater than the first distance.

9. A tool having a body with first and second ends each adapted to matingly engage a socket having a detent receiving portion, comprising:

a first receiving cavity extending from the exterior surface into the body proximal to the first end;

a first detent ball disposed in the first receiving cavity and adapted to engage the detent receiving portion within the socket when the first end is matingly engaged with the socket;

a first bias member disposed in the first receiving cavity and adapted to bias the first detent ball in an outwardly direction relative to the exterior surface and into engagement with the detent receiving portion when the first end is matingly engaged with the socket;

a second receiving cavity extending from the exterior surface into the body proximal to the second end;

a second detent ball having a diameter less than the first detent ball and disposed in the second receiving cavity and adapted to engage the detent receiving portion within the socket when the second end is matingly engaged with the socket; and a second bias member disposed in the second receiving cavity and adapted to bias the second detent ball in an outwardly direction relative to the exterior surface and into engagement with the detent receiving portion when the second end is matingly engaged with the socket, wherein when either of the first or second detent balls engages the detent receiving portion within the socket, the respective first or second bias members provides a biasing force requiring an axial force greater than 20 pounds to disengage the first or second detent ball from the detent receiving portion within the socket to allow removal of the body from the socket, and wherein the biasing force counteracts an impacting rotational force applied to the body when the tool is in use.

10. The tool of claim 9, wherein the axial force must be greater than 40 pounds to disengage either of the first or second detent ball from the detent receiving portion within the socket.

11. The tool of claim 9, wherein the first receiving cavity is spaced a first distance from an edge of the first end, and the second receiving cavity is spaced a second distance from an edge of the second end that is greater than the first distance.

12. The tool of claim 9, wherein the first end of the body includes first edge breaks.

13. The tool of claim 9, wherein the second end of the body includes second edge breaks.

14. The tool of claim 9, wherein the second end of the body is adapted to engage a detent receiving portion extending into a first receptacle in the socket opposite a second receptacle adapted to receive a drive lug of a wrench in a second end of the socket.

15. The tool of claim 9, wherein the diameter of the first detent ball is about 0.13 inches to about 0.14 inches, and the first detent ball protrudes a distance of about 0.05 inches to about 0.07 inches from the exterior surface.

16. The tool of claim 9, wherein the diameter of the second detent ball is about 0.12 inches to about 0.13 inches, and the second detent ball protrudes a distance of about 0.03 inches to about 0.04 inches from the exterior surface.

17. A tool system, comprising:

a lug, including:

a body having an exterior surface and first and second ends;

a receiving cavity extending from the exterior surface into the body proximal to the first end;

a detent ball disposed in the receiving cavity; and a bias member disposed in the receiving cavity and adapted to bias the detent ball in an outwardly direction relative to the exterior surface; and a socket adapted to matingly engage the lug, the socket includes:

a socket body portion having first and second opposing socket ends;

a receptacle extending from the first socket end into the socket body portion, wherein the receptacle is adapted to receive the first end of the lug; and a detent receiving portion in the receptacle, wherein the detent receiving portion is adapted to cooperatively engage the detent ball to detain the socket on the lug, wherein the detent ball cooperatively engages the detent receiving portion, and the bias member provides a biasing force against the detent ball requiring application of an axial force greater than 20 pounds to disengage the lug from the socket to allow removal of the socket from the lug, and wherein the biasing force counteracts an impacting rotational force applied to the lug by the socket when the tool system is in use.

18. The tool system of claim 17, wherein the detent receiving portion in the receptacle has a diameter of about 0.1 inches to about 0.11 inches.

19. A bit adapted to engage a socket, comprising:

a body having an exterior surface and first and second ends each adapted to matingly engage the socket;

a receiving cavity extending from the exterior surface into the body proximal to the first end;

a detent ball disposed in the receiving cavity and adapted to engage a detent receiving portion within the socket when the first end is matingly engaged with the socket; and a bias member disposed in the receiving cavity and adapted to bias the detent ball in an outwardly direction relative to the exterior surface, wherein when the detent ball engages the detent receiving portion within the socket, the bias member provides a biasing force against the detent ball requiring application of an axial force greater than 20 pounds to disengage the detent ball from the detent receiving portion within the socket and the bit from the socket to allow removal of the socket from the bit, and wherein the biasing force counteracts an impacting rotational force applied to the body.

* * * * *